United States Patent [19]

Ritchie et al.

[11] 4,030,087

[45] June 14, 1977

[54] ANTI-THEFT ALARM SYSTEM

[75] Inventors: Dale A. Ritchie; Walker G. Petroff; Roy G. Smarr, Jr., all of Columbia, S.C.

[73] Assignee: Augustus E. Quattlebaum, Pendleton, S.C.

[22] Filed: Mar. 12, 1976

[21] Appl. No.: 666,391

[52] U.S. Cl. ..... 340/261; 340/280; 307/117

[51] Int. Cl.[2] ..... G08B 13/22

[58] Field of Search ..... 340/261, 276, 274 R, 340/420, 258 R, 258 D, 65, 280; 307/117

[56] References Cited

UNITED STATES PATENTS

| | | | |
|---|---|---|---|
| 3,713,128 | 1/1973 | Wong et al. | 340/261 |
| 3,828,338 | 8/1974 | Kato | 340/261 |

*Primary Examiner*—John W. Caldwell
*Assistant Examiner*—William M. Wannisky
*Attorney, Agent, or Firm*—Bailey, Dority & Flint

[57] ABSTRACT

An anti-theft alarm system is provided for detecting a desired disturbance to an associated structure wherein a momentary disturbance of the structure causes the alarm to emit a short audible warning blast and if the disturbance continues, thereafterwards, the alarm will remain on until the alarm system is deactivated.

8 Claims, 2 Drawing Figures

ANTI-THEFT ALARM SYSTEM

BACKGROUND OF THE INVENTION

The removal by theft of movable objects such as bicycles and television sets has been a problem to which considerable attention has been given. In this respect, it is desirable to provide an alarm system which will emit a short warning signal to put persons disturbing the object on notice. Thereafterwards, if the disturbance continues, it is desired to activate the alarm system for emitting a continuous audible alarm system of high intensity. Such an alarm system must be highly reliable and accurate in detecting disturbances whether they be motion disturbances or other disturbance conditions such as fire and smoke. Providing a compact alarm system which can be conveniently installed within the cabinet of a television set, or other like appliance, is also desirable. However, the simplicity and compactness of the system must not sacrifice the reliability of the system in detecting a disturbance and quickly emitting an audible alarm signal.

Prior systems have been developed such as shown in U.S. Pat. No. 3,828,338 wherein an auxiliary buzzer and a main buzzer are provided. The auxiliary buzzer sounds at the first instance of a detected vibration and thereafterwards, when the vibration has occurred a predetermined number of times, as counted by a ring counter, a main buzzer is energized. Both of the buzzers are selectively connected to the power supply through relay switches.

Another alarm system is disclosed in U.S. Pat. No. 3,713,128 wherein the numbers of pulses produced by a disturbance detector are counted and once a predetermined number of counts is reached, a multivibrator is triggered to deliver a pulse to a low frequency pulse counter. When two pulses are received by the multivibrator within a predetermined amount of time, a relay coil is de-energized to actuate the audible alarm signal. However, such systems are rather sophisticated and are mainly suitable for application to stationary structures for detecting disturbances such as the entrance of burglars, or fire and smoke.

U.S. Pat. No. 3,721,956 shows a relatively simple alarm system which is operable by vibration for attachment to a device such as a bicycle. A vibration or motion responsive cantilevered member is contained within a tube and establishes momentary electrical contact with the tube for latching on a silicon control rectifier when the bicycle is moved and the alarm is activated by turning a key switch to an on position. Once the alarm is sounded, the alarm remains on until the key is switched off. No provision is made for sounding a short audible warning signal prior to the continuous operation of the alarm signal so that the person disturbing the object has the option of ceasing his disturbance in which instance the alarm will not be continuously activated.

SUMMARY OF THE INVENTION

An alarm system is provided for detecting a desired disturbance condition to an associated structure. The alarm system has a buzzer for emitting an audible alarm signal in response to detecting a disturbance, a d-c power source connected to the buzzer for supplying current thereto. A first and second switch means is connected in series with the buzzer and the power source for delivering current to the buzzer. The first switch means is manually operated to activate the alarm system. A disturbance detecting circuit is provided for controlling the second switch means comprising a detection means for detecting the disturbance condition and producing a detection signal. A first digital logic gate having an input coupled to the detection means is provided for receiving the detection signal and producing a conditioned output signal of a predetermined level. A second digital logic gate has a first input coupled to the output of the first logic gate for receiving the predetermined output signal. A latch-up circuit is coupled to a second input of the second logic gate for gating the second logic gate on and clamping the output of the second logic gate at a predetermined level when the disturbance is detected for a predetermined period of time. A third logic gate provides a high gain inverting amplifier having an input coupled to the output of the second logic gate and an output coupled to the second switch means. The third logic gate inverts the output of the second logic gate producing an output signal for biasing the second switch means into conduction. Current is then delivered to the buzzer for emitting an audible alarm signal when the system is activated and a disturbance is detected.

Accordingly, an important object of the present invention is to provide a highly reliable alarm system which is compact and may be readily installed within or to a removable object.

Another object of the present invention is to provide a highly reliable alarm system which will emit a short audible warning signal and thereafterwards, will emit a continuous alarm signal if the disturbance does not cease.

Still another important object of the present invention is to provide a reliable and inexpensive alarm system which can be readily affordable for installation within the cabinet of a removable appliance such as a television set to discourage the removal thereof from the premises on which it is located.

Yet another important object of the present invention is to provide an alarm system having a highly reliable digital control circuit for detecting a disturbance condition and controlling the operation of an audible alarm signal wherein the digital circuit provides fast and accurate switching of the alarm in response to a disturbance.

DESCRIPTION OF A PREFERRED EMBODIMENT

The system of the present invention relates to an anti-theft alarm which may be mounted on a removable object such as a bicycle, television, and the like. If the object is disturbed by movement thereof, the alarm system will emit an audible warning signal. The alarm system has particular advantage when mounted within the cabinet of a television set and like appliances to signal the attempted removal from the premises. The alarm system may also be utilized to detect other conditions which require the activation of an alarm such as the detection of smoke, fire, or water conditions. Since the application of the present invention will be basically the same, it will be unnecessary to illustrate all of them herein and have, accordingly, chosen to illustrate the invention in connection with a motion disturbance detector.

Figure 1:
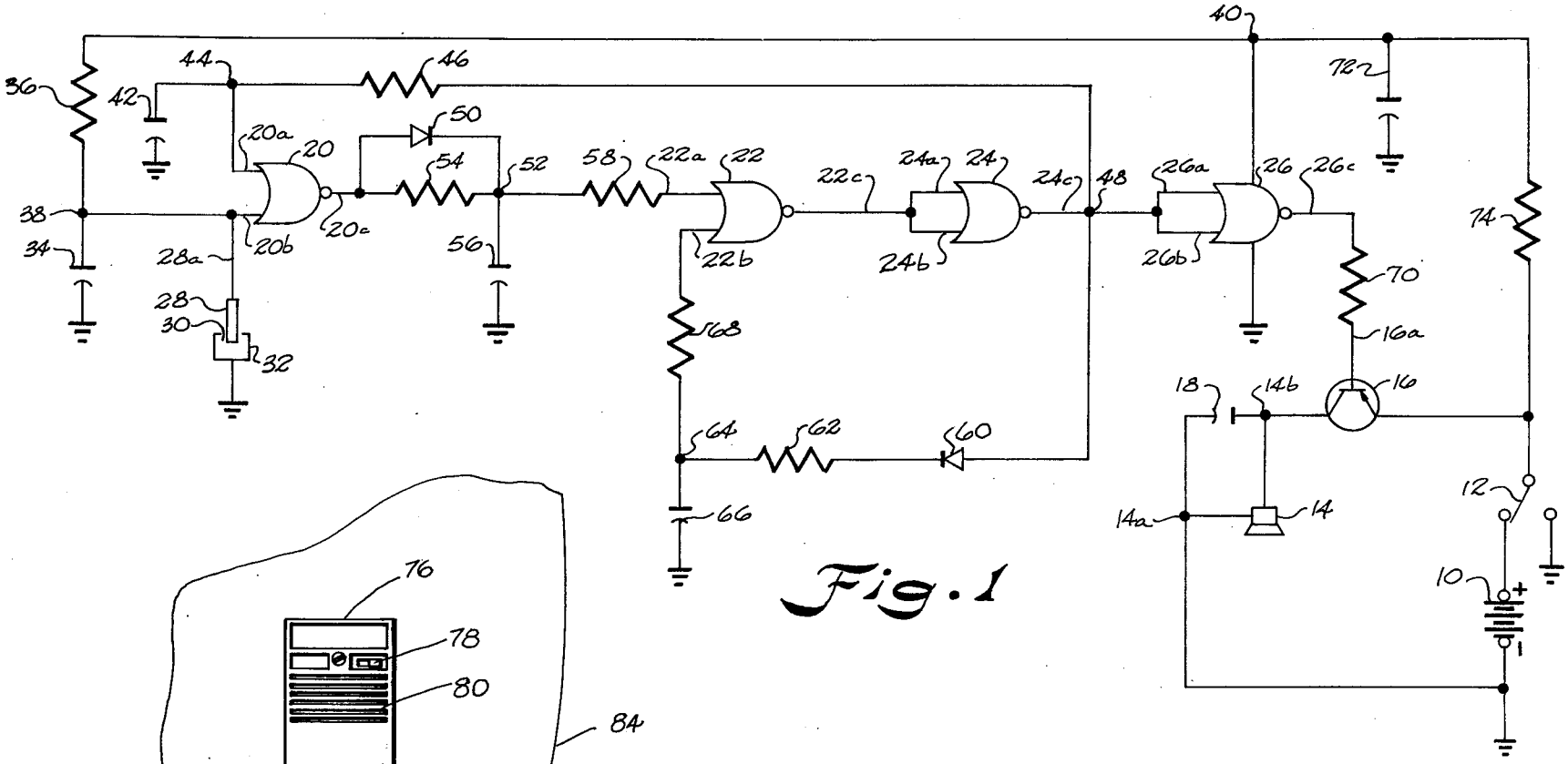

Referring now to the circuit diagram of FIG. 1, the components of the alarm system include a direct current power source 10 for supplying power to the alarm system circuit and a switch 12 for selectively placing the alarm system in an activated or off condition. The audible alarm signal emitted by the system is preferably provided by a buzzer 14. One suitable buzzer having high intensity is provided by a buzzer having a sound level of 90 decibles at 10 ft., a voltage of 6 volts d.c., and a coil resistance of 10 ohms minimum. One terminal 14*a* of the buzzer is connected to ground and the other terminal 14*b* is connected by way of a power transistor 16 to the positive side of the power source 10. A capacitor 18 is connected across the terminals 14*a* and 14*b* of the buzzer to suppress any electrical noise generated by the buzzer.

The logic gate 20 functions as a disturbance detector and a signal conditioning amplifier. Connected to the input 20*b* of the logic gate 20 is a capacitor 34 and a resistor 36 forming a network which functions as a power on test signal and a pulse stretcher circuit for the pendulum contactor 28. The resistor 36 and the capacitor 34 are connected to the logic gate input 20*b* at junction 38. The other side of capacitor 34 is connected to ground and the other side of resistor 36 is connected at a junction 40 with logic gate 26.

A capacitor 42 is connected to the logic gate input terminal 20*a* at junction 44 and the other side of capacitor 42 is connected to ground. A resistor 46 is connected to logic gate terminal 20*a* at junction 44 and the other side of resistor 46 is connected to a junction 48. Capacitor 44 and resistor 46 form a delay circuit for reducing the possible detrimental effect of positive feedback from the buzzer 14 which could force the pendulum contactor 28 into self-sustaining oscillations.

A diode 50 has its anode connected to the output terminal 20*c* of logic gate 20, and its cathode connected to a junction 52. Also connected to the logic gate output terminal 20*c* is a resistor 54 which is in parallel with diode 50. A capacitor 56 has one side connected to the junction 52 and the other side grounded. The diode 50, resistor 54, and capacitor 56 are connected so as to form a pulse conditioning network which shapes the disturbance detection voltage spikes generated by logic gate 20 for fast and accurate switching.

A resistor 58 is connected at one side to the junction of 52 and at the other side to an input terminal 22*a* of logic gate 22. The output terminal 22*c* of logic gate 22 is connected to the input terminals 24*a* and 24*b* of a logic gate 24. Logic gate circuits 22 and 24 are coupled together to form a logical OR gate. The logic gate output terminal 24*c* is connected to junction 48. A diode 60 has its anode connected to the junction 48 and its cathode connected to a resistor 62. The other side of resistor 62 is connected to a junction 64. A capacitor 66 has one side connected to the junction 64 and is grounded at the other side. Also connected to the junction 64 is one side of a resistor 68 whose other side is connected to an input terminal 22*b* of logic gate 22.

The diode 60, resistor 62, and capacitor 66 form a latch-up circuit which charges the capacitor 66 proportional to the number and intensity of disturbances of detector 28. The capacitor 66 is charged by the output voltage level of logic gate 24, through the diode 60, and the resistor 62. The capacitor 66 is discharged through the inherent internal leakage thereof. When the pendulum contact 28 remains grounded through retainer 32, through either high frequency repetitive contact or continuous contact, a predetermined period of time whereby the input 20*b* is maintained at a low level for a sufficient period of time, the output 24*c* is sufficient to charge capacitor 64 above the threshold level of input 22*b*. In this condition, the alarm circuit is latched or clamped on, and the buzzer 14 will emit an audible alarm until either the switch 12 is manually opened or the power source 10 is exhausted. The input 22*b* will be clamped at a high voltage level as will be the output 24*c*.

The logic gates 22 and 24 are connected to form a logical OR gate which is gated by the disturbance detector and/or by the circuitry for the above described latch-up circuit.

Connected to the junction 48 are the input terminals 26*a* and 26*b* of the logic gate 26. The logic gate 26 functions as a high gain inverting amplifier which drives the transistor 16. A current limiting resistor 70 is connected between the output terminal 26*c* of logic gate 26 and the base 16*a* of transistor 16. A capacitor 72 and a resistor 74 form a filter for filtering any electrical noises generated by the circuit.

In operation, once the alarm is activated by closing switch 12, any movement of the pendulum contact 28 due to someone disturbing the device to which the alarm is attached, causes the pendulum contactor 28 to make a momentary ground connection from the input 20*b* of logic gate 20 through the container 32 to ground. Input 20*b* switches from a 1 to a 0. This causes the output terminal 20*c* to switch from a 0 to a 1 at a high voltage level. Capacitor 56 is then charged to the output voltage level at 20*c* through diode 50. The high voltage level across capacitor 56 is transferred to the input terminal 22*a* of logic gate 22, causing the output terminal 22*c* to switch to a low voltage level of 0. This causes the output terminal 24*c* of logic gate 24 to switch to a high voltage level of 1. Thus, the output 24*c* is in phase with input 22*a* and the NOR gates 22 and 24 are coupled to form an OR gate.

This high voltage level at the output terminal 24*c* of logic gate 24 produces three reactions in the circuit. First, the output terminal 26*c* of logic gate 26 is switched to a low 0 level, allowing base current to be drawn from transistor 16 through resistor 70. Transistor 16 is thereby forced into saturation and collector current is delivered to the buzzer 14, which generates an audible alarm signal. Second, the capacitor 66 is charged through the diode 60 and resistor 62 by the high output voltage level at 24*c*. Third, the delay circuit comprised of resistor 46 and capacitor 42 is activated. If the movement of the pendulum contact 28 is ceased, the pendulum will return to its rest position out of contact with the side of container 32. This causes the logic gate input terminal 20*b* to return to a high voltage level after a short delay produced by the resistor 36 and capacitor 34 network. The output terminal 20*c* of logic gate 20 will then switch back to its low voltage level. If capacitor 66 has not yet been charged above the threshold level of gate input 22*b*, the power to buzzer 14 will be interrupted and the alarm signal will stop.

Once the output terminal 20*c* is switched back to its normal low voltage level, the capacitor 56 will begin to discharge through resistor 54 into the output terminal 20*c*. The resultant effect of the controlled discharge rate of capacitor 56 is to maintain a relative constant pulse width duration at the input terminal 22*a* of logic gate 22 after the disturbance of pendulum contact 28 has ceased. When the voltage across the capacitor 56 has dropped below the switching threshold of the input terminal 22*a* of logic gate 22, the logic gate output terminal 22*c* will return to its normal high voltage level. The output terminal 24*c* of logic gate 24 will then switch back to its low level of voltage, providing that the voltage cross capacitor 66 has not exceeded the switching threshold of the other input terminal 22*b* of logic gate 22.

If the output terminal 24*c* of logic gate 24 is allowed to return to its normally low voltage level, the logic gate 26 which acts as a high gain inverting amplifier will switch to its normal high voltage level resulting in the transistor 16 being biased to a nonconducting condition turning off the buzzer 14.

However, in the event that the disturbance of pendulum contactor 28 continues a predetermined number or period of time due to movement of the device to which it is attached, the capacitor 66 will continue to charge until it reaches a predetermined level at which the alarm circuit will latch-up. In this instance, the voltage at input terminal 22*b* of logic gate 22 will be high and will continue to hold the logic gate output terminal 22*c* at a low level thus maintaining the output 24*c* of logic gate 24 at a high level. The output 24*c* will be clamped at a high 1 level. This maintains the inverting amplifier 26 at a low level biasing the power transistor 16 into a conducting mode for supplying current to the buzzer 14 which will continue to sound a continous audible alarm signal until either the alarm circuit is either disarmed by way of switch 12 or the energy of the d-c power source 10 is depleted.

When the switch 12 is first closed to initially activate the alarm in an operational condition for detecting disturbances, a short momentary test signal is emitted by the buzzer 14 to indicate that the alarm system is functioning and that the batteries comprising power source 10 are in good condition. This momentary power on test signal is produced by the delay circuit comprising resistor 46 and capacitor 42. This circuit delays the input of a high voltage level of 1 from the power source 10 to the logic gate input 20*a* a sufficient time duration so that the voltage at the input 20*a* is momentarily at a low level causing the output 26*c* of logic gate 26 to momentarily go low, through the switching of gates 22 and 24 as in the above operation, cutting on power transistor 16 producing a short audible test signal.

Figure 2:
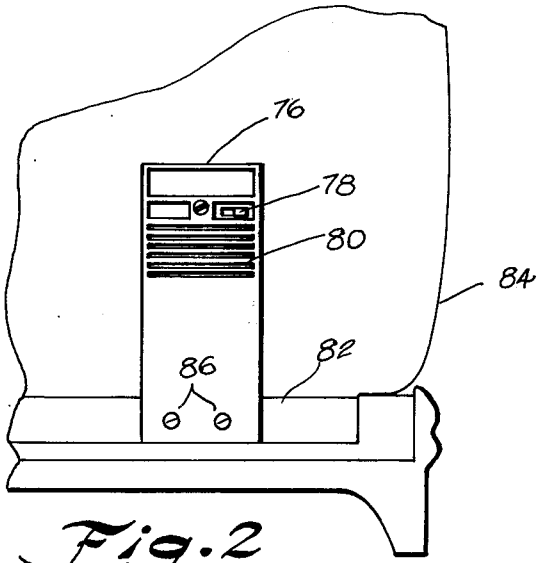

As illustrated in FIG. 2, the alarm system, including the integrated circuit, is preferably enclosed in a casing 76. A sliding button switch 78 is provided for actuating switch 12 which activates the alarm in an operational condition. Switch 78 may also be in the form of a key operated switch. The buzzer 14 is enclosed behind an acoustic grill 80. The casing 76 may be attached in any suitable manner such as to a chasis 82 when installed inside a cabinet 84 of a television set by utilizing screws 86. The back cover of the television set may then be replaced with tamper-proof screws. Installation must be such that pendulum contact 28 hangs in a true vertical position.

Thus, it can be seen that the alarm system constructed in accordance with the present invention supplies an effective anti-theft device which may be mounted to a variety of associated appliances and other devices for preventing their unauthorized removal. At the first instance of disturbance, the alarm system will produce a warning signal and if the person causing the disturbance leaves the associated appliance or device alone, the signal will not repeat. However, if the person removing the appliance or device continues to disturb it, the alarm system circuit will latch on for a substantial amount of time attracting attention to the removal of the appliance or device.

The digital detection circuit provides a very accurate and fast switching circuit responsive to disturbance conditions for controlling the audible alarm. By responding to discrete voltage levels, the detection circuit is highly responsive and reliable and does not tend to be falsely triggered.

While a preferred embodiment of the invention has been described using specific terms, such description is for illustrative purposes only, and it is to be understood that changes and variations may be made without departing from the spirit or scope of the following claims.

What is claimed is:

1. In an alarm system for detecting a desired disturbance to an associated structure, said system having a buzzer for emitting an audible alarm signal in response to said detection, a d-c power source connected to said buzzer for supplying current thereto, first and second switch means connected in series with said buzzer and said power source for selectively connecting said buzzer to said power source, said first switch means being manually operated to activate said alarm system, a disturbance detecting circuit for controlling said second switch means comprising:

a detection means for detecting said disturbance and producing a detection signal;

a first digital logic gate means having a first input terminal coupled to said detection means for receiving said detection signal and producing a conditioned output signal of a predetermined level;

a second digital logic gate means having first and second input terminals and an output terminal, said first input terminal coupled to said first logic gate means for receiving said predetermined output signal and producing an output signal of a predetermined voltage level;

latch-up means coupled to said input terminal of said second logic gate for gating said second logic gate on and clamping the output terminal of said second logic gate at said predetermined voltage level when said disturbance is continued for a predetermined period of time;

a third digital logic gate means providing a high gain inverting amplifier having an input coupled to the output terminal of said second logic gate means and an output terminal coupled to said second switch means;

said third logic gate means inverting said predetermined output voltage of said second logic gate producing an output signal for switching said second switch means into conduction; and said buzzer emitting a short audible alarm signal when said system is activated an an initial disturbance is detected and, thereafterward, said buzzer emitting a continuous audible alarm signal when said disturbance is continued for said predetermined period of time.

2. In an alarm system as in claim 1 wherein said latch-up means includes a capacitor charged by the output voltage of said second logic gate means, said second logic gate output being clamped at said predetermined voltage level when said capacitor is charged to a level exceeding the gating threshold of said second input to maintain said audible alarm signal on until said circuit is de-activated.

3. In an alarm system as in claim 1 further comprising a delay circuit means coupled to said first input of said first digital logic gate means for momentarily establishing an input signal at said first input of said first gate means producing an output signal at said third gate means for switching said second switch means into conduction producing a momentary power on audible test signal from said buzzer when said first switch is initially closed.

4. In an alarm system as in claim 1 further comprising a signal conditioning network coupled between said first logic gate output and the input of said second logic gate shaping the output signal from said first logic gate means for fast and accurate switching of said second gate means.

5. In an alarm system as in claim 1 further comprising a delay circuit means coupled to the output of said second gate means and a second input of said first gate means for reducing vibrational feedback from said buzzer when energized.

6. An alarm system for detecting a desired disturbance condition to an associated structure having a buzzer for emitting an audible alarm signal in response to said disturbance, a d-c power source connected to said buzzer for supplying current thereto, first and second switch means connected in series with said buzzer and said power source for selectively connecting said buzzer to said power source, said first switch means being manually operated to activate said alarm system, and a disturbance detecting circuit for controlling said second switch means comprising a detection means for detecting said disturbance and producing a detection signal, logic gate means having a first and second input terminal and an output terminal, said first input terminal being connected to said detection means for receiving said detection signal and producing an output voltage of a predetermined level, latch-up means coupled to said second input terminal of said logic gate means for gating said logic gate means on and clamping said output terminal of said logic gate means at a predetermined voltage level when said disturbance continues for a predetermined duration of time, said second switch means including a semi-conductor switch means coupled to said output terminal of said logic gate means responsive to said predetermined voltage level for connecting said buzzer to said power source whereby said buzzer emits said audible alarm signal.

7. The alarm system as set forth in claim 6 further comprising delay circuit means coupled to said first input terminal of said logic gate means for momentarily establishing an input signal at said first input terminal at the moment that said first switch means is initially closed for momentarily gating on said logic gate means and thus producing a momentary output signal of a predetermined voltage level for switching said semi-conductor switch means to produce a momentary power on audible test signal from said buzzer when said first switch is initially closed.

8. The alarm system as set forth in claim 6 wherein said buzzer emits a short audible alarm signal when said system is activated by closure of said first switch means and an initial disturbance is detected, and, thereafterwards said buzzer emits a continuous audible alarm signal when said disturbance is continued for said predetermined duration of time.

* * * * *